United States Patent [19]

L'Abbe et al.

[11] Patent Number: 4,475,248

[45] Date of Patent: Oct. 9, 1984

[54] EXPLOSIVE ORDINANCE DISPOSAL HELMET

[75] Inventors: Richard L'Abbe; Andre M. St. Laurent, both of Ottawa; James A. Newman, Gloucester; Brian M. Gallup, Kanata, all of Canada

[73] Assignee: Canadian Patents & Development Limited, Ottawa, Canada

[21] Appl. No.: 383,765

[22] Filed: Jun. 1, 1982

[51] Int. Cl.[3] ..... F41H 1/04

[52] U.S. Cl. ..... 2/2.5; 2/424; 179/156 R

[58] Field of Search ..... 2/2.5, 422, 424, 423, 2/421, 414, 9, 6, 171.3, 10; 455/89, 100; 179/156 A, 182 R, 156 R

[56] References Cited

U.S. PATENT DOCUMENTS

| | | | |
|---|---|---|---|
| 3,166,761 | 1/1965 | Strohm | 2/421 |
| 3,180,333 | 4/1965 | Lewis | 179/156 R |
| 3,582,990 | 6/1971 | Frieder | 2/187 X |
| 3,586,977 | 6/1971 | Lustig | 179/156 R |
| 3,858,242 | 1/1975 | Gooding | 2/10 |
| 3,943,572 | 3/1976 | Aileo | 2/423 X |
| 4,095,289 | 6/1978 | Kissen et al. | 2/6 X |
| 4,259,747 | 4/1981 | Taesler | 2/6 |

*Primary Examiner*—Peter P. Nerbun

*Attorney, Agent, or Firm*—Robert G. Hendry

[57] ABSTRACT

A ballistic helmet for use by bomb disposal personnel which includes a covering of soft ballistic nylon over a rigid polycarbonate shell. The shell is lined with semi-shock attenuating foam and is designed to cover the entire head. A transparent visor in the front of the helmet can easily be removed by the wearer and a blower assembly provides fresh air inside the helmet to eliminate fogging of the visor. The assembly incorporates an integral communication headset and microphone. Stability of the complete unit on the wearer's head is accomplished by a double-strap retention system.

10 Claims, 4 Drawing Figures

EXPLOSIVE ORDINANCE DISPOSAL HELMET

This invention relates to protective clothing and, in particular, to a helmet for use by bomb disposal personnel.

Explosive ordinance helmets available for use with EOD suits leave areas of the wearer's head unprotected. A helmet of this type is described in U.S. Pat. No. 3,582,990, entitled "Ballistic Cover for a Protective Helmet". Furthermore, these helmets are uncomfortable to wear for extended periods of time due to poor weight distribution. A further deficiency of prior armoured helmets is the tendency of the helmet to tilt forward, particularly if the faceplate is lifted to improve visibility when a technician is attempting to dismantle an explosive device.

It is, therefore, an object of this invention to provide increased protection at the sides of the face and the neck of the wearer.

Another object of the invention is the provision of a microphone and earphones within the helmet.

A further object of this invention is the provision of a readily removable, transparent face shield.

A still further object of this invention is the provision of a remote microphone to monitor sound outside the helmet.

A still further object of this invention is the provision of a supply of air within the helmet to substantially eliminate fogging of the face shield and provide air for the wearer.

Accordingly, the present invention provides a ballistic helmet for use by bomb disposal personnel, having a rigid shell, a shock attenuating liner within the shell, a plurality of layers of ballistic fabric forming an outer covering for the rigid shell, and a removable face shield covering a frontal opening in the helmet.

Figure 1:
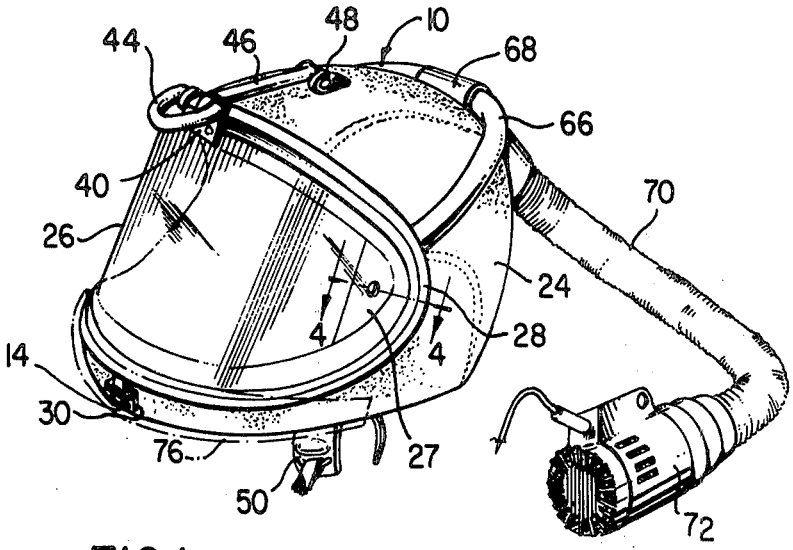
Figure 3:
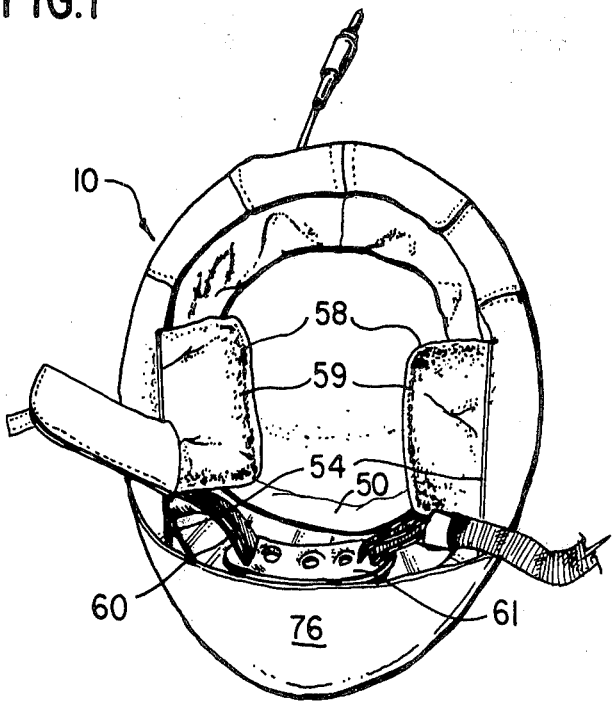
Figures 2, 4:
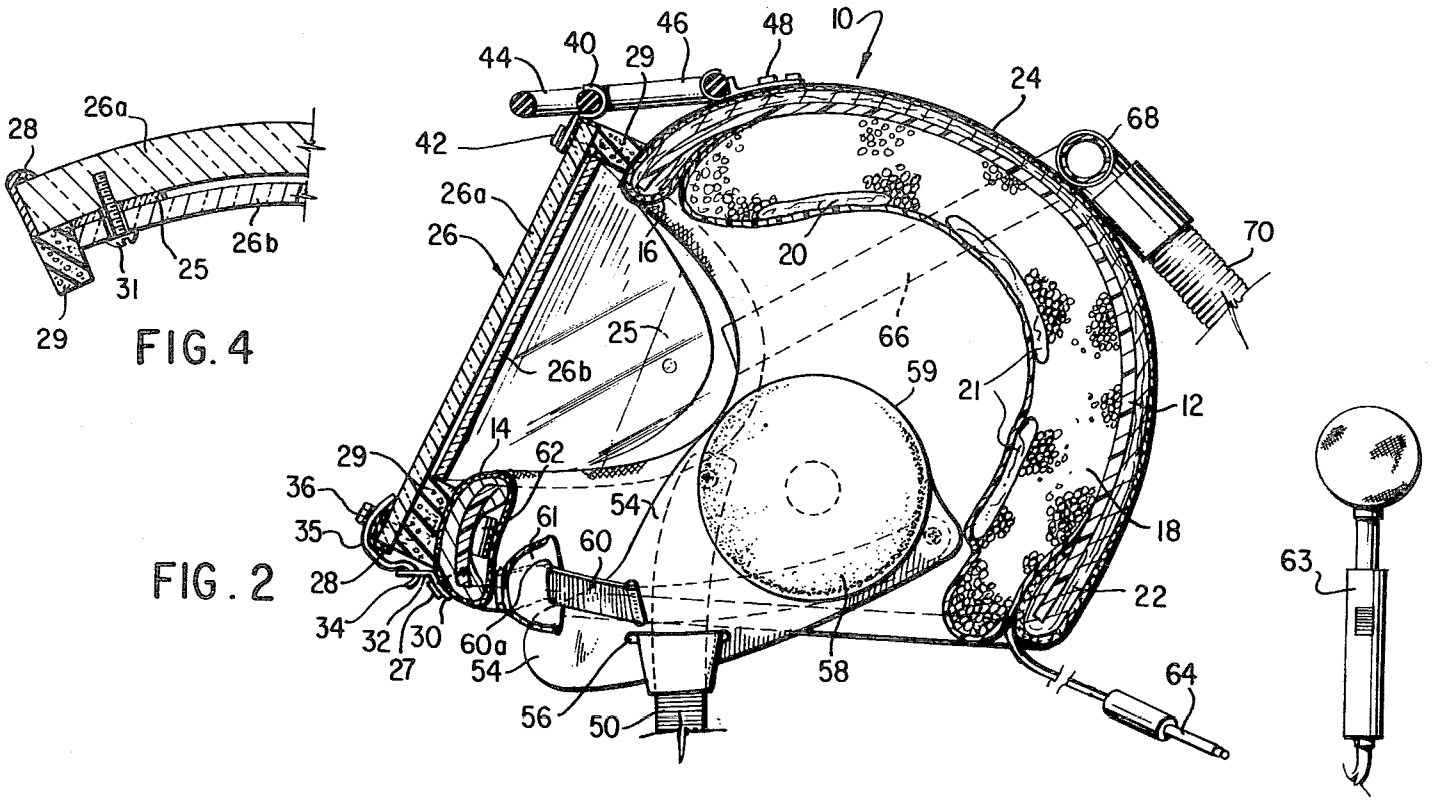

In the accompanying drawings, which illustrate a preferred embodiment of the invention, FIG. 1 is a perspective view of a ballistic helmet in accordance with this invention, FIG. 2 is a side-elevational, cross-section view of the helmet of FIG. 1, FIG. 3 is a plan view of the underside of the helmet, FIG. 4 is a partial section taken along the line 4—4 of FIG. 1.

Referring now in detail to the drawings, a helmet shown generally at 10 in FIG. 1 comprises a molded shell 12 of a suitable plastic material such as a polycarbonate resin. The shell 12 includes a chin protector portion 14 and microphone mount below the opening 16 in the front of the helmet 10.

A shock attenuating liner 18 of foamed plastic, such as expanded beads of polystyrene, is provided within the shell 12. The liner 18 is moulded to suit the largest head size required and foam pads 20 may be used to accommodate smaller head sizes. A leatherette comfort liner 21 covers the shock absorbing liner 18.

The outer surface of the shell 12 is provided with a covering 22 of a plurality of layers of ballistic fabric, preferably a ballistic fabric sold under the name Kevlar [trademark] by I. E. Dupont de Nemours Co. Ltd., which is cut and sewn to the shape of the helmet 10. It has been found that six layers of Kevlar will provide a ballistic rating of 315 meters per second. Kevlar polyamide fiber reinforced inomer resin has high impact resistance for use in light-weight munition fragment-resistant armor.

The ballistic covering 22 is provided with an outer fire resistant cover 24 of heat resistant nylon, sold under the name Nomex [trademark] by the Dupont Co. Nomex is a high temperature grade of nylon. This class of polymer, now classified as aramids, retains about 60% of its strength at 475° to 500° F., which would melt conventional nylons.

The frontal opening 16 of the helmet is provided with a transparent plastic face shield or visor 26 which comprises a first acrylic sheet **26*a* of approximately one-half inch in thickness, and a second polycarbonate sheet 26*b* of approximately one-quarter inch in thickness, spaced from said first sheet approximately 0.04 of the inch by a spacer 25 shown more clearly in FIG. 4. The acrylic sheet 26*a*, the spacer 25 and the polycarbonate sheet 26*b* are secured together by screws 31. The sheet 26*b* is smaller than the sheet 26*a* so that if a projectile passes through sheet 26*a*, the screws 31 may be dislodged causing the visor 26** to delaminate, thus providing an energy absorbing mechanism.

Tests have shown that such acrylic and polycarbonate visors have a ballistic V-50 rating, 730 meters per second when the ballistic object is the NATO Fragment Simulator. A V-50 rating is the velocity of a projectile at which there is a 50% probability of the projectile piercing the armor. The projectile used in determining the V-50 ratings of the face piece and helmet is a one gram, 22 caliber, hardened steel slug known as a fragment simulator whose geometry is specified by NATO STANAG Part No. T37/17. The test procedure is also specified by NATO STANAG No. 2920 (Standarization NATO Agreement). The noted velocity is the time it takes the projectile to cross two electric eyes divided by the distance between the two electric eyes.

A suitable neoprene or similar rubber moulding 28 is provided around the periphery of the visor 26 and a neoprene foam gasket 29 is secured to the periphery of the inner face of the visor 26. The lower edge of the visor 26 is secured to the helmet 10 by means of a centrally located anchor bracket 30 secured to the chin protector 14 by fastening means 27, and has a slot 32 to receive a tab 34 on an angle bracket 35 secured to the visor 26 by bolts and nuts, or rivets or screws 36.

The upper edge of the visor 26 has a bracket 40 secured by any fastening means, such as nuts, bolts, screws or rivets 42, which is releasably engaged by a loop 44 of an elastic member 46. The other end of the elastic member 46 is secured to the helmet 10 by fastening means 48.

The primary retention systems (chin strap) 50 consists of two straps made of ¾ inch nylon or polypropylene webbing. Both straps are sewn to steel hangers which are fastened to the helmet via screws, bolts, nuts, rivets or other fastening devices. Each strap is covered with a leatherette covering extending from the hangers to approximately halfway down the strap. Two "D" (not shown) shaped rings (known as D-rings) are sewn to the free extremity of the left retention strap through which the right half of the primary retention system is fitted, thus securing the helmet on a wearer's head. One of the D-rings is fitted with a tab which, when pulled, serves as a quick release mechanism for the chip strap.

Semi-rigid plastic members 54 are mounted for limited rotational movement on each side of the helmet 10. Each of the members 54 has a slot 56 through which the chin strap extends. The helmet has a pair of earphones or speakers 58 one of which is secured to each of the plastic members 54. The speakers 58 are adapted to be moved towards the wearer's ears by the plastic members 54 as the chin strap 50 is tightened.

The earphones or speakers 58 have a covering of E.A.R. foam-type plastic 59 which is capable of high frequency, high amplitude sound attenuation to protect the wearer's ears in the event of an explosion.

A second strap 60, known as an anterior-posterior strap, to control anterior-posterior movement of the helmet 10, passes through slots 60*a* in the plastic members and has its outer ends secured to the sides of the helmet 10. A chin cup 61 is provided on the second strap 60.

Controlling the backward and forward tilt of the helmet 10 is very important to the comfort of the wearer as fatigue in the neck muscles would otherwise be experienced due to shifting of the weight of the helmet. Movement of the helmet on the wearer's head could also cause parts of the head to be exposed or to interfere with vision and head movement. The second strap also adjuts the speakers 58 and the ear pads snugly about the ears of the wearer.

In addition to the earphones 58, a microphone 62 is provided in the chin protector portion 14 and a suitable electrical connection for a two-way radio is shown at 64 in FIG. 2.

An exterior microphone 63 may be provided for the purpose of reinstituting the hearing loss inherent to wearing head and ear protection. The unit is, however, more sensitive than the human ear and, as such, serves as an aid in detecting what may be unnatural sounds. The microphone unit consists of two assemblies, the microphone proper and a fixed gain amplifier. The exterior microphone is completely compatible with communications equipment in the helmet and with any transceiver that is or would be compatible with the communications equipment in the helmet. Use of either microphone (exterior or built-in) is switch selectable.

It will be appreciated that because the helmet 10 is almost completely enclosed, it is desirable to provide the wearer with a supply of fresh air. Also of importance, is the provision of air to prevent fogging of the visor 26. As shown in FIG. 1, this is accomplished by inserting the open ends of a U-shaped tube 66 through notches in the neoprene foam gasket 29. The mid-portion of the tube 66 passes through and is in communication with a "T" junction 68 secured to the helmet. The "T" in turn is connected to the flexible hose 70 of a battery powered electric blower 72. The weight of the blower 72 acts to counter balance the weight of the visor 26.

For added protection, the helmet 10 is fitted with a neck protecting skirt 76, shown in FIG. 3 and in broken lines in FIG. 1. The skirt 76 is fastened to the visor 26 and the helmet 10 by fastening means sold under the name Scotchmate, Velcro [trade-marks] or by any other convenient fastening means. The skirt 76 comprises twenty-two layers of Kevlar covered with Nomex.

We claim:

1. A ballistic helmet for use by bomb disposal personnel comprising a rigid shell, a shock attenuating liner in said shell, and a plurality of layers of ballistic fabric forming an outer covering for said shell, said helmet being shaped to cover the entire head of a wearer and provide a chin protector portion, a frontal opening in said helmet adapted to be covered by a readily removable, transparent plastic face shield, an anchor means on said chin protector having a slot to receive a tab on said visor and a bracket on an upper edge of said visor releasably engaged by an elastic member one of which is secured to said helmet and a supply of air to the interior of said helmet.

2. A ballistic helmet as claimed in claim 1 wherein said ballistic fabric is a polyamide fiber.

3. A ballistic helmet as claimed in claim 1 wherein a cover for the layers of ballistic material comprises a high temperature grade of nylon known as polyaramide.

4. A ballistic helmet as claimed in claim 1 wherein said face shield comprises two layers, spaced apart, of transparent thermoplastics.

5. A ballistic helmet as claimed in claim 1 wherein said face shield comprises two layers, spaced apart, of transparent polycarbonate resin.

6. A ballistic helmet as claimed in claim 1 wherein said supply of air is directed at an inner face of said visor through one or more tubes on said helmet.

7. A ballistic helmet as claimed in claim 1 wherein an outer layer of said visor is transparent acrylic and said inner layer is a transparent polycarbonate sheet secured to said outer layer by screws adapted to permit de-lamination of said visor if a projectile passing through said outer layer strikes said inner layer.

8. A ballistic helmet as claimed in claim 1 wherein a first chin strap anchored to said helmet is adapted to extend under the chin of the wearer and a second strap anchored adjacent said first strap is adapted to extend around the front portion of the wearer's chin.

9. A ballistic helmet as claimed in claim 8 wherein a pair of semi-flexible members having slots therein are pivotally anchored to said helmet and have earphones secured thereto whereby said first and second straps extend through said slots and urge said earphones toward the wearer's head.

10. A helmet as claimed in claim 1 wherein a transceiver is provided which includes a microphone and earphones mounted within the helmet and a remote microphone compatible with said transceiver provided on the exterior of said helmet for monitoring sound outside the helmet.

* * * * *